US010029903B1

(12) United States Patent
White

(10) Patent No.: US 10,029,903 B1
(45) Date of Patent: Jul. 24, 2018

(54) BOTTLE TRANSFER COUPLING DEVICE

(71) Applicant: Karen F. White, Watertown, TN (US)

(72) Inventor: Karen F. White, Watertown, TN (US)

( * ) Notice: Subject to any disclaimer, the term of this patent is extended or adjusted under 35 U.S.C. 154(b) by 26 days.

(21) Appl. No.: 15/257,212

(22) Filed: Sep. 6, 2016

(51) Int. Cl.

| | |
|---|---|
| ***B65B 1/04*** | (2006.01) |
| ***B67C 11/02*** | (2006.01) |
| ***B67C 9/00*** | (2006.01) |
| *B67C 11/00* | (2006.01) |

(52) U.S. Cl.
CPC ..... *B67C 11/02* (2013.01); *B67C 9/00* (2013.01); *B67C 2011/30* (2013.01)

(58) Field of Classification Search
CPC ..... B67C 11/02; B67C 9/00; B67C 2011/30
See application file for complete search history.

(56) References Cited

U.S. PATENT DOCUMENTS

| | | | |
|---|---|---|---|
| 3,028,032 | A | 4/1962 | Jones |
| 3,266,533 | A | 8/1966 | Mchale |
| 3,620,267 | A | 11/1971 | Seablom |
| 3,877,499 | A | 4/1975 | Fluster |
| 5,642,763 | A | 7/1997 | Kurtz |
| D480,608 | S | 10/2003 | Haslam, Sr. |
| 9,199,832 | B2 | 12/2015 | Fracasso |

FOREIGN PATENT DOCUMENTS

| | | | |
|---|---|---|---|
| WO | 2014176563 | A1 | 10/2014 |

*Primary Examiner* — Jason K Niesz
(74) *Attorney, Agent, or Firm* — Kyle A. Fletcher, Esq.

(57) ABSTRACT

The bottle transfer coupling device is adapted for use with a plurality of containers. The bottle transfer coupling device is a device that transfers the contents of a first container selected from the plurality of containers to a second container selected from the plurality of containers. The bottle transfer coupling device transports the contents of the first selected container to the second selected container using a sealed transport mechanism that minimizes the loss of the contents of the first container or the second container during the transfer process. The bottle transfer coupling device comprises a first funnel, a second funnel, and a coupling pipe. The coupling pipe attaches the first funnel to the second funnel to create a fluid bearing channel between the first funnel and the second funnel such that fluids from the first container will be transported to the second container.

20 Claims, 4 Drawing Sheets

BOTTLE TRANSFER COUPLING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of filling or emptying of jars, bottles or similar containers with liquids, more specifically, a device for emptying a bottle not otherwise provided for.

SUMMARY OF INVENTION

The bottle transfer coupling device is adapted for use with a plurality of containers. The bottle transfer coupling device is a device that transfers the contents of a first container selected from the plurality of containers to a second container selected from the plurality of containers. The bottle transfer coupling device transports the contents of the first selected container to the second selected container using a sealed transport mechanism that minimizes the loss of the contents of the first container or the second container during the transfer process.

These together with additional objects, features and advantages of the bottle transfer coupling device will be readily apparent to those of ordinary skill in the art upon reading the following detailed description of the presently preferred, but nonetheless illustrative, embodiments when taken in conjunction with the accompanying drawings.

In this respect, before explaining the current embodiments of the bottle transfer coupling device in detail, it is to be understood that the bottle transfer coupling device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bottle transfer coupling device.

It is therefore important that the claims be regarded as including such equivalent construction insofar as they do not depart from the spirit and scope of the bottle transfer coupling device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

Figure 1:
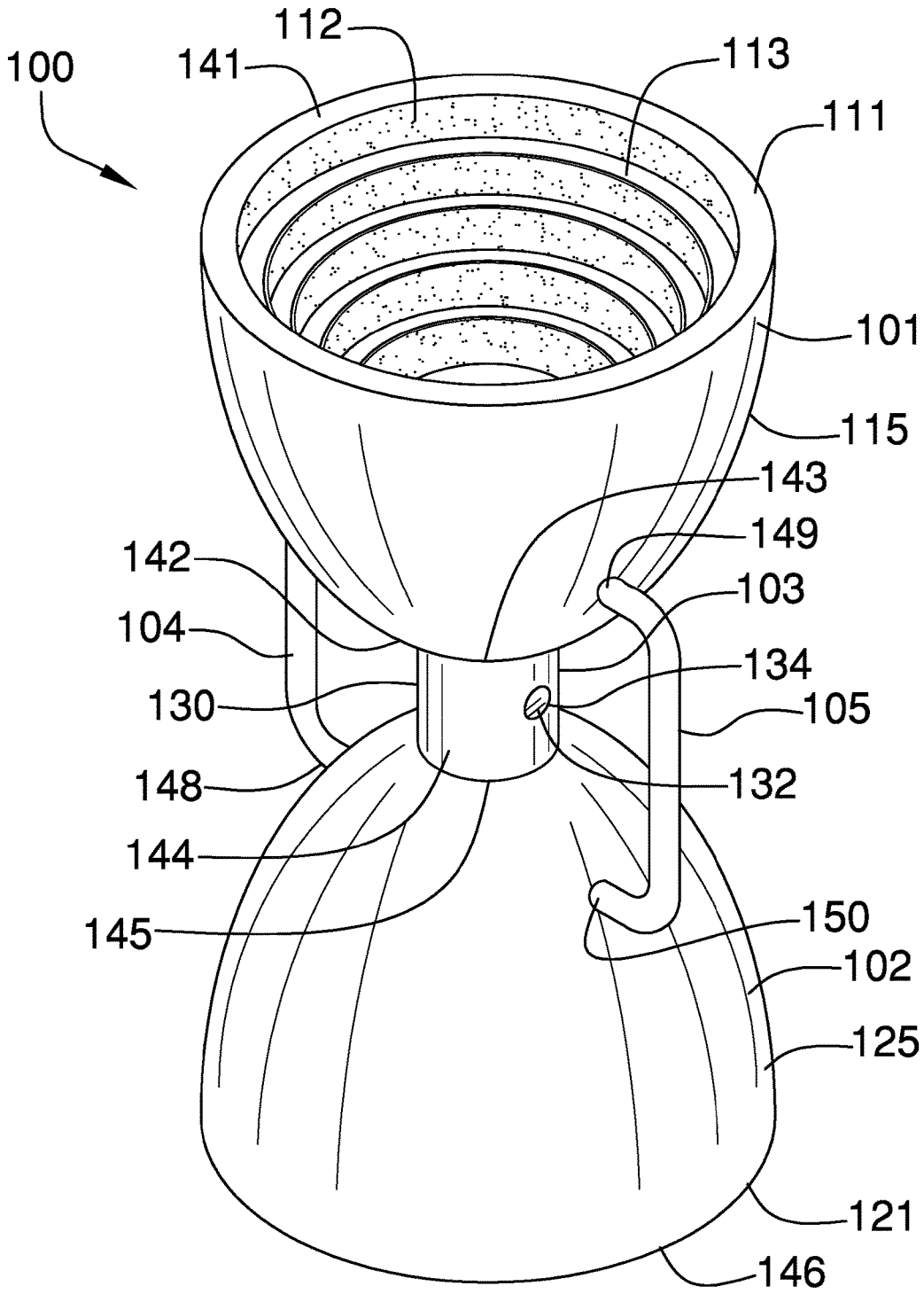
FIG. 1 is a perspective view of an embodiment of the disclosure.
Figure 3:
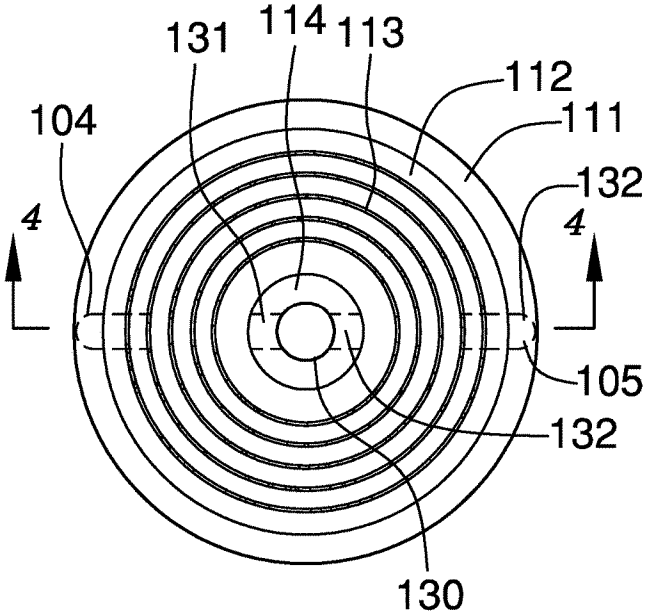
FIG. 3 is a top view of an embodiment of the disclosure.
Figure 2:
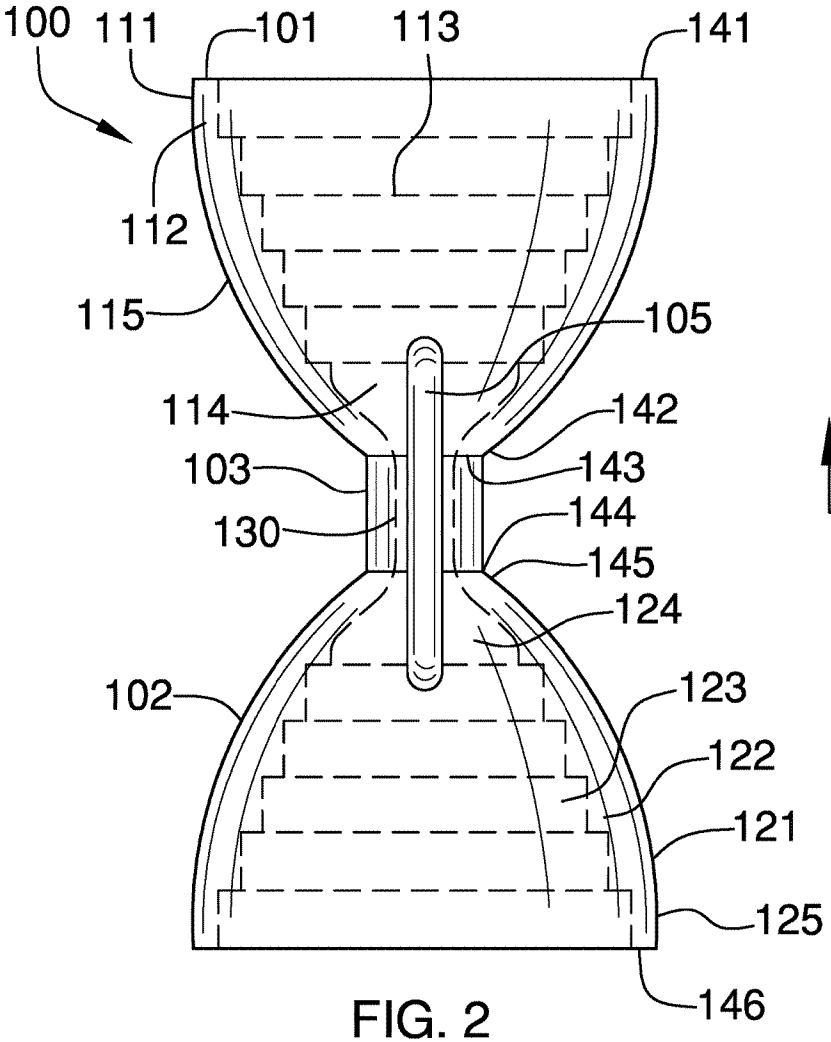
FIG. 2 is a side view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The bottle transfer coupling device 100 (hereinafter invention) comprises a first funnel 101, a second funnel 102, and a coupling pipe 103. The coupling pipe 103 connects the first funnel 101 to the second funnel 102 to create a fluid bearing channel between the plurality of containers 160 such that fluids from a first container 161 will be transported to a second container 162. The invention 100 is adapted for use with a plurality of containers 160. Each of the plurality of containers 160 is further defined with a mouth 163, a rim 164, and a finished edge 165. The invention 100 is a device that transfers the contents of a first container 161 selected from the plurality of containers 160 to a second container 162 selected from the plurality of containers 160. The invention 100 transports the contents of the first selected container to the second selected container using a sealed transport mechanism that minimizes the loss of the contents of the first container 161 or the second container 162 during the transfer process. The first funnel 101 is further defined with a first end 141 and a second end 142. The coupling pipe 103 is further defined with a third end 143 and a fourth end 144. The second funnel 102 is further defined with a fifth end 145 and a sixth end 146.

The first funnel 101 comprises a first hollow shell 111, a first plug 112, a first conical plate 113, a first connecting funnel 114, and a first exterior surface 115. The first plug 112 is inserted into the interior of the first hollow shell 111. The first conical plate 113 and the first connecting funnel 114 are negative spaces formed within the first plug 112.

The first hollow shell 111 is a first hollow structure that is formed in the shape of the frustum of a quadric surface. The parallel planes that form the frustum of the quadric surface are perpendicular to the major axis of the quadric surface. It is preferred that the quadric surface be selected from the group consisting of a cone or an ellipsoid. The first hollow shell 111 is formed such that the first end 141 of the first funnel 101 forms an opening such that the mouth 163 and the rim 164 of each container contained in the plurality of containers 160 can be inserted into the first funnel 101 through the first end 141. The contents entering the first funnel 101 through the mouth 163 of a container are sealed using the first plug 112.

The first plug 112 is a structure that is placed in the interior of the first hollow shell 111. The first plug 112 is formed from an elastic material that creates an air and gas impermeable seal that that minimizes the loss of the contents of the first container 161 or the second container 162 during the transfer process. In the first potential embodiment of the disclosure, the first plug 112 is formed from silicone. The first plug 112 has further formed in a first negative space called first conical plate 113 and second negative space called the first connecting funnel 114. The first conical plate 113 has the shape of a conical plate wherein the plate of the first conical plate 113 of the largest diameter span forms the opening at the first end 141 of the first funnel 101 and the plate of the conical plate with the smallest diameter span is the location of the first conical plate 113 that is distal from the first end 141. The plate of the first conical plate 113 of the largest diameter span is positioned such that: 1) the center of the plate of the largest diameter span is aligned with the major axis of the quadric surface that forms the first hollow shell 111; and, 2) the surface of the plate of the largest diameter span that has the greatest surface area is perpendicular to the major axis of the quadric surface that forms the first hollow shell 111.

Figure 4:
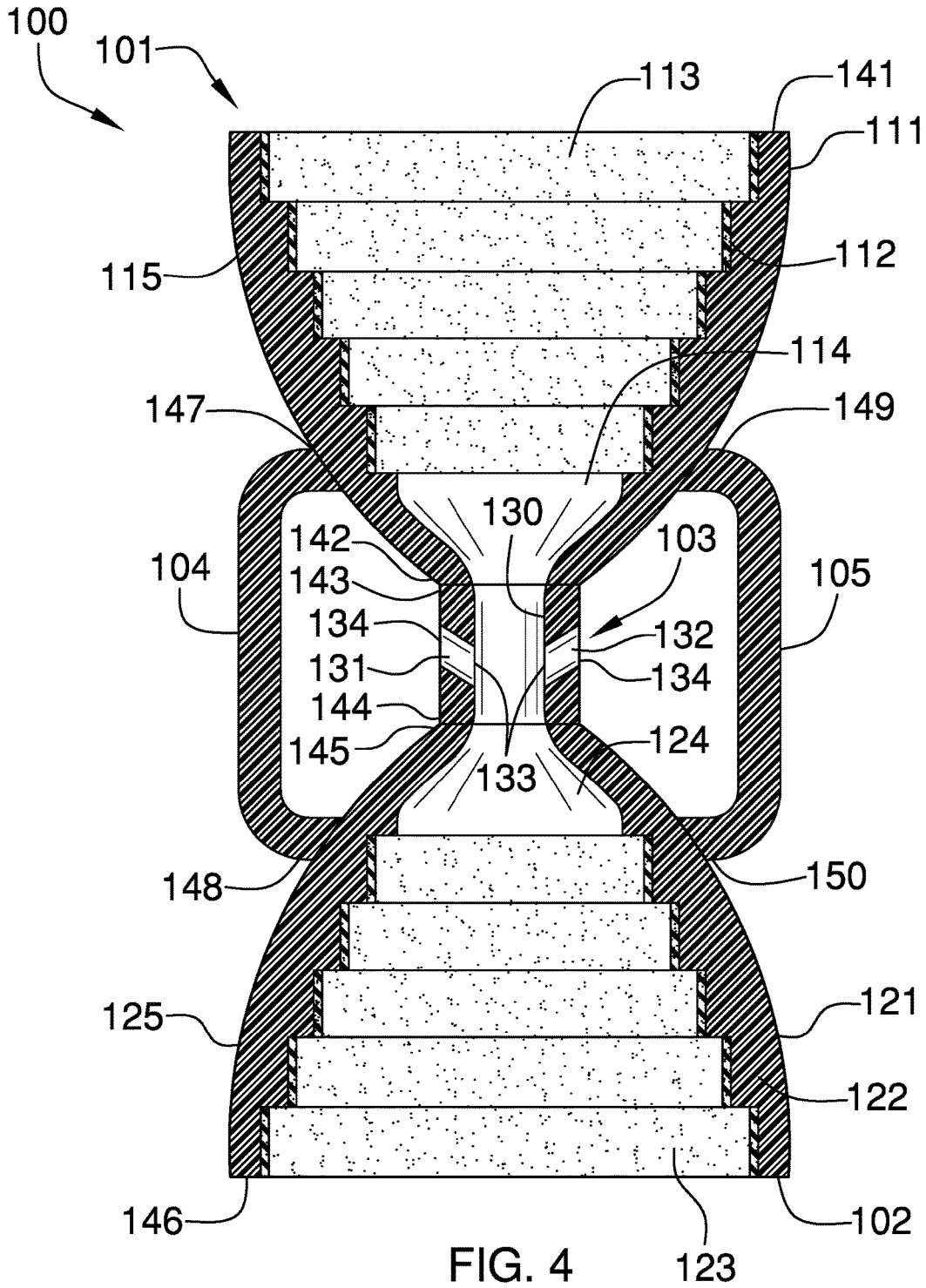
FIG. 4 is a cross-sectional view of an embodiment of the disclosure across 4-4 as shown in FIG. 3.
Figure 5:
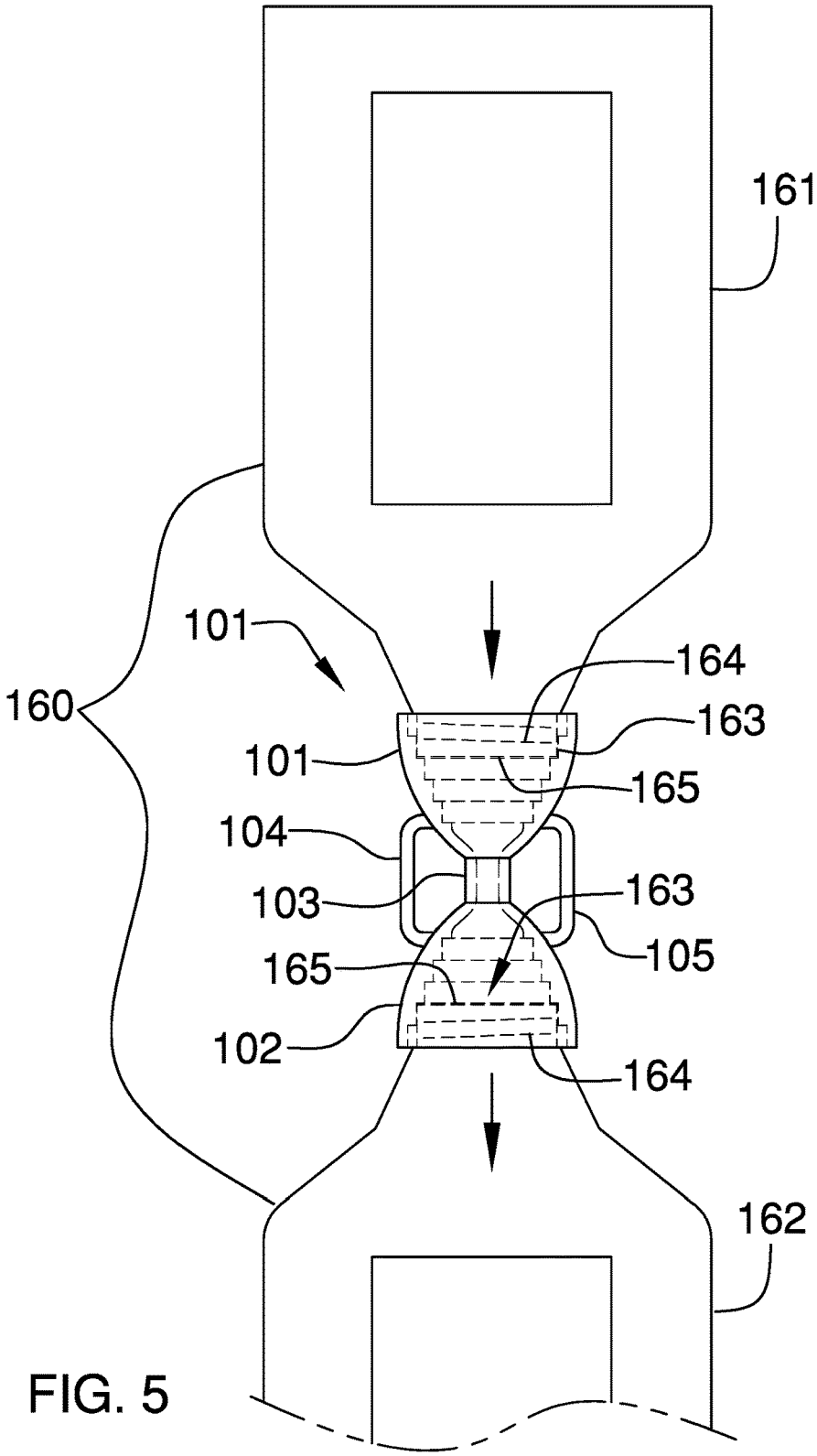
FIG. 5 is an in use view of an embodiment of the disclosure.

As shown most clearly in FIGS. 4 and 5, the first conical plate 113 forms a first series of steps formed by the change in diameter between the disks of the first conical plate 113. The finished edge 165 of the mouth 163 will press against one of these steps when a container selected from the plurality of containers 160 is inserted into the first funnel 101. The insertion of the finished edge 165, the mouth 163 and the rim of the container selected from the plurality of containers 160 places a stress on the elastic material that forms the first plug 112 causing the first plug 112 to deform. The forces created by the first plug 112 attempting to return to its relaxed shape will create a gas and fluid impermeable seal between the first funnel 101 and the container selected from the plurality of containers 160.

The first connecting funnel 114 is a funnel shaped opening that creates a fluid bearing channel from the first conical plate 113 to the second end 142 of the first funnel 101. The second end 142 of the first funnel 101 is formed with an opening such that when the second end 142 of the first funnel 101 is attached to the third end 143 of the coupling pipe 103 fluid flowing through the first connecting funnel 114 will flow into the coupling pipe 103.

The second funnel 102 comprises a second hollow shell 121, a second plug 122, a second conical plate 123, a second connecting funnel 124, and a second exterior surface 125. The second plug 122 is inserted into the interior of the second hollow shell 121. The second conical plate 123 and the second connecting funnel 124 are negative spaces formed within the second plug 122.

The second hollow shell 121 is a second hollow structure that is formed in the shape of the frustum of a quadric surface. The parallel planes that form the frustum of the quadric surface are perpendicular to the major axis of the quadric surface. It is preferred that the quadric surface be selected from the group consisting of a cone or an ellipsoid. The second hollow shell 121 is formed such that the sixth end 146 of the second funnel 102 forms an opening such that the mouth 163 and the rim 164 of each container contained in the plurality of containers 160 can be inserted into the second funnel 102 through the sixth end 146. The contents flowing through the second funnel 102 into the mouth 163 of a container are sealed using the second plug 122.

The second plug 122 is a structure that is placed in the interior of the second hollow shell 121. The second plug 122 is formed from an elastic material that creates an air and gas impermeable seal that that minimizes the loss of the contents of the first container 161 or the second container 162 during the transfer process. In the first potential embodiment of the disclosure, the second plug 122 is formed from silicone. The second plug 122 has further formed in a third negative space called second conical plate 123 and fourth negative space called the second connecting funnel 124. The second conical plate 123 has the shape of a conical plate wherein the plate of the second conical plate 123 of the largest diameter span forms the opening at the sixth end 146 of the second funnel 102 and the plate of the second conical plate 123 with the smallest diameter span is the location of the second conical plate 123 that is distal from the sixth end 146. The plate of the second conical plate 123 of the largest diameter span is positioned such that: 1) the center of the plate of the largest diameter span is aligned with the major axis of the quadric surface that forms the second hollow shell 121; and, 2) the surface of the plate of the largest diameter span that has the greatest surface area is perpendicular to the major axis of the quadric surface that forms the second hollow shell 121.

As shown most clearly in FIGS. 4 and 5, the second conical plate 123 forms a second series of steps formed by the change in diameter between the disks of the second conical plate 123. The finished edge 165 of the mouth 163 will press against one of these steps when a container selected from the plurality of containers 160 is inserted into the second funnel 102. The insertion of the finished edge 165, the mouth 163 and the rim 164 of the container selected from the plurality of containers 160 places a stress on the elastic material that forms the second plug 122 causing the second plug 122 to deform. The forces created by the second plug 122 attempting to return to its relaxed shape will create a gas and fluid impermeable seal between the second funnel 102 and the container selected from the plurality of containers 160.

The second connecting funnel 124 is a funnel shaped opening that creates a fluid bearing channel from the fifth end 145 of the second funnel 102 to the second conical plate 123. The fifth end 145 of the second funnel 102 is formed with an opening such that when the fifth end 145 of the second funnel 102 is attached to the fourth end 144 of the coupling pipe 103 fluid flowing through the coupling pipe 103 will flow into the second connecting funnel 124.

The coupling pipe 103 further comprises a cylindrical pipe 130, a first vent 131 and a second vent 132. The first vent 131 and a second vent 132 are formed in the face of the cylindrical pipe 130. The third end 143 of the coupling pipe 103 attaches to the second end 142 of the first funnel 101. The fourth end 144 of the coupling pipe 103 attaches to the fifth end 145 of the second funnel 102. The first vent 131 is a first aperture that is formed through the face of the coupling pipe 103. The second vent 132 is a second aperture that is formed through the face of the coupling pipe 103. The purpose of the first vent 131 and the second vent 132 is to all the flow of air into and out of the fluid channel formed by the invention 100 to maintain the equalized pressures required for smooth fluid flows.

As shown most clearly in FIG. 4, the interior opening 133 of the first vent 131 is distal to the third end 143 of the coupling pipe 103 relative to the exterior opening 134 of the first vent 131. Similarly, the interior opening 133 of the second vent 132 is distal to the third end 143 of the coupling pipe 103 relative to the exterior opening 134 of the second vent 132. This relative positioning of the interior openings 133 and the exterior openings 134 prevents the loss of fluids when fluid flows from the first funnel 101 to the second funnel 102. However, the relative positioning of the interior openings 133 and the exterior openings 134 requires that fluid flow through the invention 100 be limited to the direction from the first funnel 101 to the second funnel 102.

The invention 100 further comprises a first handle 104 and a second handle 105. The first handle 104 forms a first loop on the invention 100. The first handle 104 is further defined with a seventh end 147 and an eighth end 148. The first handle 104 is a U shaped structure. The seventh end 147 of the first handle 104 attaches to the first exterior surface 115 of the first hollow shell 111. The eighth end 148 of the first handle 104 attaches to the exterior face of the coupling pipe 103. The second handle 105 forms a second loop on the invention 100. The second handle 105 further comprises a ninth end 149 and a tenth end 150. The second handle 105 is a U shaped structure. The tenth end 150 of the second handle 105 attaches to the second exterior surface 125 of the second hollow shell 121. The ninth end 149 of the second handle 105 attaches to the exterior face of the coupling pipe 103.

The first handle 104 and the second handle 105 are sized such that neither handle will extend beyond the following boundaries: 1) a hypothetical first right cylinder which is the smallest size that permits for the complete insertion of the first hollow shell 111 such that the center axis of the hypothetical first right cylinder and the major axis of the quadric surface the forms the first hollow shell 111 are aligned; and, 2) a hypothetical second right cylinder which is the smallest size that permits for the complete insertion of the second hollow shell 121 such that the center axis of the hypothetical second right cylinder and the major axis of the quadric surface the forms the second hollow shell 121 are aligned.

To use the invention 100 the first container 161 that contains the contents to be transferred is placed into the first end 141 of the first funnel 101. The second container 162 that is destined to receive the contents of the first container 161 is placed into the sixth end 146 of the second funnel 102. The first container 161 is positioned relative to the second container 162 such that gravity will feed the contents of the first container 161 into the second container 162.

In the first potential embodiment of the disclosure, the first hollow shell 111, the second hollow shell 121, the coupling pipe 103, the first handle 104, and the second handle 105 are formed from molded plastic. Suitable plastics include, but are not limited to, polyethylene and polycarbonate.

The following definitions were used in this disclosure:

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface.

Conical Plate: As used in this disclosure, a conical plate is a structure that is formed from a plurality of plates. Each plate selected from the plurality of plates is differentiated from plates remaining in the plurality of plates by the span of the diameter of the plate of the selected disk compared to the span of the corresponding diameter of the remaining plates in the plurality of plates. The plurality of plates are stacked upon each other such that: 1) the centers of each of the plurality of plates are aligned such these centers form a line that is perpendicular to the supporting surface upon which the plurality of plates are stacked; 2) the plurality of plates are stacked in a decreasing order based of the span of the diameter of the plate; 3) the plurality of plates are stacked such that the plate with the maximum span of the diameter of the plate is proximal to the supporting surface; and, 4) the plurality of plates are stacked such that the plate with the minimum span of the diameter of the plate is distal from the supporting surface. A conical plate formed from a plurality of circular disks is commonly seen and often referred to as a Tower of Hanoi.

Correspond: As used in this disclosure, the term correspond means that a first object is in some manner linked to a second object in a one to one fashion.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. A right cylinder is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Disk: As used in this disclosure, a disk is a cylindrically shaped object that is flat in appearance.

Elastic: As used in this disclosure, an elastic is a material or object that deforms when a force is applied to it and that is able to return to its original shape after the force is removed. A material that exhibits these qualities is also referred to as an elastomeric material.

Ellipsoid: As used in this disclosure, an ellipsoid is a three dimensional geometric surface through which all planar surfaces from either circles or ellipses. An ellipsoid is a type of quadric surface.

Exterior: As used in this disclosure, the exterior is use as a relational term that implies that an object is not contained within the boundary of a structure or a space.

Frustum: As used in this disclosure, a frustum is a portion of a solid that lies between two parallel planes that intersect with the solid.

Funnel: As used in this disclosure, a funnel is a hollow cone shaped object with openings at the apex and base of the cone.

Interior: As used in this disclosure, the interior is use as a relational term that implies that an object is contained within the boundary of a structure or a space.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Quadric Surface: As used in this disclosure, a quadric surface is a three dimensional surface that varies in the three Cartesian coordinates in an algebraically defined manner that is related to conic sections. Euclidian planes as well as the surfaces of ellipsoids, spheres, paraboloids, and cones are examples of quadric surfaces. The Euclidian plane is technically considered a degenerate form of a quadric surface and, unless specifically stated otherwise within this disclosure, is explicitly included in this definition. Quadric surfaces are described by the general algebraic form: $Ax^2+By^2+Cz^2+Dxy+Exz+Fyz+Gx+Hy+Iz+J=0$.

Relaxed Shape: As used in this disclosure, a structure is considered to be in its relaxed state when no shear, strain, or torsional forces are being applied to the structure.

Silicone: As used in this disclosure, silicone is a substance formed from silicon (Si) and oxygen (O) that forms the backbone of polymer type chains similar to polymers that are formed by carbon.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A device comprising:

a first funnel, a second funnel, and a coupling pipe;

wherein the device is adapted for use with a plurality of containers;

wherein each of the plurality of containers is further defined with a mouth, a rim, and a finished edge;

wherein the coupling pipe connects the first funnel to the second funnel to create a fluid bearing channel between the plurality of containers;

wherein the device transfers the contents of a first container selected from the plurality of containers to a second container selected from the plurality of containers;

wherein the device transports the contents of the first selected container to the second selected container using a sealed transport mechanism;

wherein the first funnel is further defined with a first end and a second end;

wherein the coupling pipe is further defined with a third end and a fourth end;

wherein the second funnel is further defined with a fifth end and a sixth end.

2. The device according to claim 1 wherein fluid flow through the device is unidirectional.

3. The device according to claim 2 wherein wherein the first funnel comprises a first hollow shell, a first plug, a first conical plate, a first connecting funnel, and a first exterior surface;

wherein the first plug is inserted into the interior of the first hollow shell;

wherein the first conical plate and the first connecting funnel are negative spaces formed within the first plug;

wherein the first hollow shell is a first hollow structure that is formed in the shape of the frustum of a first quadric surface;

wherein the parallel planes that form the frustum of the first quadric surface are perpendicular to the major axis of the first quadric surface;

wherein the first hollow shell is formed such that the first end of the first funnel forms an opening such that the mouth and the rim of each container contained in the plurality of containers can be inserted into the first funnel through the first end;

wherein the contents entering the first funnel through the mouth of a container are sealed using the first plug;

wherein the second funnel comprises a second hollow shell, a second plug, a second conical plate, a second connecting funnel, and a second exterior surface;

wherein the second plug is inserted into the interior of the second hollow shell;

wherein the second conical plate and the second connecting funnel are negative spaces formed within the second plug;

wherein the second hollow shell is a second hollow structure that is formed in the shape of the frustum of a second quadric surface;

wherein the parallel planes that form the frustum of the quadric surface are perpendicular to the major axis of the second quadric surface;

wherein the second hollow shell is formed such that the sixth end of the second funnel forms an opening such that the mouth and the rim of each container contained in the plurality of containers can be inserted into the second funnel through the sixth end;

wherein the contents flowing through the second funnel into the mouth of a container are sealed using the second plug.

4. The device according to claim 3 wherein the first plug has further formed in a first negative space called first conical plate and second negative space called the first connecting funnel;

wherein the first plug is formed from an elastic material;

wherein the first conical plate has the shape of a conical plate wherein the plate of the first conical plate of the largest diameter span forms the opening at the first end of the first funnel;

wherein the plate of the conical plate with the smallest diameter span is the location of the first conical plate that is distal from the first end;

wherein the second plug has further formed in a third negative space called second conical plate and fourth negative space called the second connecting funnel;

wherein the second conical plate has the shape of a conical plate wherein the plate of the second conical plate of the largest diameter span forms the opening at the sixth end of the second funnel;

wherein the plate of the conical plate with the smallest diameter span is the location of the second conical plate that is distal from the sixth end;

wherein the first plug is formed from an elastic material.

5. The device according to claim 4 wherein the plate of the first conical plate of the largest diameter span is positioned such that the center of the plate of the largest diameter span is aligned with the major axis of the first quadric surface that forms the first hollow shell;

wherein the plate of the first conical plate of the largest diameter span is positioned such that the surface of the plate of the largest diameter span that has the greatest surface area is perpendicular to the major axis of the first quadric surface that forms the first hollow shell;

wherein the plate of the second conical plate of the largest diameter span is positioned such that the center of the plate of the largest diameter span is aligned with the major axis of the second quadric surface that forms the second hollow shell;

wherein the plate of the second conical plate of the largest diameter span is positioned such that the surface of the plate of the largest diameter span that has the greatest surface area is perpendicular to the major axis of the second quadric surface that forms the second hollow shell.

6. The device according to claim 5 wherein the first conical plate forms a first plurality of steps formed by the change in diameter between the disks of the first conical plate;

wherein the finished edge of a first container selected from the plurality of containers will press against a step selected from the first plurality of steps when a container selected from the plurality of containers is inserted into the first funnel;

wherein the forces created by the first plug attempting to return to its relaxed shape will create a gas and fluid impermeable seal between the first funnel and the first container;

wherein the second conical plate forms a second plurality of steps formed by the change in diameter between the disks of the second conical plate;

wherein the finished edge of a second container selected from the plurality of containers will press against a step selected from the second plurality of steps when a container selected from the plurality of containers is inserted into the second funnel;

wherein the forces created by the second plug attempting to return to its relaxed shape will create a gas and fluid impermeable seal between the second funnel and the second container.

7. The device according to claim 6 wherein the first connecting funnel is a funnel shaped opening that creates a fluid bearing connection from the first conical plate to the second end of the first funnel;

wherein the second end of the first funnel is formed with an opening such that when the second end of the first funnel is attached to the third end of the coupling pipe fluid flowing through the first connecting funnel will flow into the coupling pipe;

wherein the second connecting funnel is a funnel shaped opening that creates a fluid bearing connection from the second conical plate to the fifth end of the second funnel;

wherein the fifth end of the second funnel is formed with an opening such that when the fifth end of the second funnel is attached to the fourth end of the coupling pipe fluid flowing through the second connecting funnel will flow into the second connecting funnel.

8. The device according to claim 7 wherein the coupling pipe further comprises a cylindrical pipe, a first vent and a second vent;

wherein the first vent and a second vent are formed in the face of the cylindrical pipe;

wherein the third end of the coupling pipe attaches to the second end of the first funnel;

wherein the fourth end of the coupling pipe attaches to the fifth end of the second funnel.

9. The device according to claim 8 wherein the first vent is a first aperture that is formed through the face of the coupling pipe;

wherein the second vent is a second aperture that is formed through the face of the coupling pipe;

wherein the first vent is further defined with a first interior opening and a first exterior opening;

wherein the second vent is further defined with a second interior opening and a second exterior opening.

10. The device according to claim 9 wherein the first vent maintains the equalized air pressures required for smooth fluid flows;

wherein the second vent maintains the equalized air pressures required for smooth fluid flows.

11. The device according to claim 10 wherein the first interior opening of the first vent is distal to the third end of the coupling pipe relative to the first exterior opening of the first vent;

wherein the second interior opening of the second vent is distal to the third end of the coupling pipe relative to the second exterior opening of the second vent.

12. The device according to claim 11 wherein the device further comprises a first handle and a second handle;

wherein the first handle forms a first loop on the device;

wherein the second handle forms a second loop on the device.

13. The device according to claim 12 wherein the first handle is further defined with a seventh end and an eighth end;

wherein the second handle further comprises a ninth end and a tenth end;

wherein the first handle is a u shaped structure;

wherein the second handle is a u shaped structure;

wherein the seventh end of the first handle attaches to the first exterior surface of the first hollow shell;

wherein the eighth end of the first handle attaches to the exterior face of the coupling pipe;

wherein the tenth end of the second handle attaches to the second exterior surface of the second hollow shell;

wherein the ninth end of the second handle attaches to the exterior face of the coupling pipe.

14. The device according to claim 13 wherein the first handle is sized such that the first handle is contained with a hypothetical first right cylinder which is the smallest size that permits for the complete insertion of the first hollow shell such that the center axis of the hypothetical first right cylinder and the major axis of the quadric surface the forms the first hollow shell are aligned;

wherein the second handle is sized such that the second handle is contained with a hypothetical second right cylinder which is the smallest size that permits for the complete insertion of the second hollow shell such that the center axis of the hypothetical second right cylinder and the major axis of the quadric surface the forms the second hollow shell are aligned.

15. The device according to claim 14 wherein the first quadric surface be selected from the group consisting of a cone or an ellipsoid;

wherein the second quadric surface be selected from the group consisting of a cone or an ellipsoid.

16. The device according to claim 15 wherein the first plug is formed from silicone;

wherein the second plug is formed from silicone.

17. The device according to claim 1 wherein wherein the first funnel comprises a first hollow shell, a first plug, a first conical plate, a first connecting funnel, and a first exterior surface;

wherein the first plug is inserted into the interior of the first hollow shell;

wherein the first conical plate and the first connecting funnel are negative spaces formed within the first plug;

wherein the first hollow shell is a first hollow structure that is formed in the shape of the frustum of a first quadric surface;

wherein the parallel planes that form the frustum of the first quadric surface are perpendicular to the major axis of the first quadric surface;

wherein the first hollow shell is formed such that the first end of the first funnel forms an opening such that the mouth and the rim of each container contained in the plurality of containers can be inserted into the first funnel through the first end;

wherein the contents entering the first funnel through the mouth of a container are sealed using the first plug;

wherein the second funnel comprises a second hollow shell, a second plug, a second conical plate, a second connecting funnel, and a second exterior surface;

wherein the second plug is inserted into the interior of the second hollow shell;

wherein the second conical plate and the second connecting funnel are negative spaces formed within the second plug;

wherein the second hollow shell is a second hollow structure that is formed in the shape of the frustum of a second quadric surface;

wherein the parallel planes that form the frustum of the quadric surface are perpendicular to the major axis of the second quadric surface;

wherein the second hollow shell is formed such that the sixth end of the second funnel forms an opening such that the mouth and the rim of each container contained in the plurality of containers can be inserted into the second funnel through the sixth end;

wherein the contents flowing through the second funnel into the mouth of a container are sealed using the second plug;

wherein the first plug has further formed in a first negative space called first conical plate and second negative space called the first connecting funnel;

wherein the first plug is formed from an elastic material;

wherein the first conical plate has the shape of a conical plate wherein the plate of the first conical plate of the largest diameter span forms the opening at the first end of the first funnel;

wherein the plate of the conical plate with the smallest diameter span is the location of the first conical plate that is distal from the first end;

wherein the second plug has further formed in a third negative space called second conical plate and fourth negative space called the second connecting funnel;

wherein the second conical plate has the shape of a conical plate wherein the plate of the second conical plate of the largest diameter span forms the opening at the sixth end of the second funnel;

wherein the plate of the conical plate with the smallest diameter span is the location of the second conical plate that is distal from the sixth end;

wherein the first plug is formed from an elastic material;

wherein the plate of the first conical plate of the largest diameter span is positioned such that the center of the plate of the largest diameter span is aligned with the major axis of the first quadric surface that forms the first hollow shell;

wherein the plate of the first conical plate of the largest diameter span is positioned such that the surface of the plate of the largest diameter span that has the greatest surface area is perpendicular to the major axis of the first quadric surface that forms the first hollow shell;

wherein the plate of the second conical plate of the largest diameter span is positioned such that the center of the plate of the largest diameter span is aligned with the major axis of the second quadric surface that forms the second hollow shell;

wherein the plate of the second conical plate of the largest diameter span is positioned such that the surface of the plate of the largest diameter span that has the greatest surface area is perpendicular to the major axis of the second quadric surface that forms the second hollow shell;

wherein the first conical plate forms a first plurality of steps formed by the change in diameter between the disks of the first conical plate;

wherein the finished edge of a first container selected from the plurality of containers will press against a step selected from the first plurality of steps when a container selected from the plurality of containers is inserted into the first funnel;

wherein the forces created by the first plug attempting to return to its relaxed shape will create a gas and fluid impermeable seal between the first funnel and the first container;

wherein the second conical plate forms a second plurality of steps formed by the change in diameter between the disks of the second conical plate;

wherein the finished edge of a second container selected from the plurality of containers will press against a step selected from the second plurality of steps when a container selected from the plurality of containers is inserted into the second funnel;

wherein the forces created by the second plug attempting to return to its relaxed shape will create a gas and fluid impermeable seal between the second funnel and the second container;

wherein the first connecting funnel is a funnel shaped opening that creates a fluid bearing connection from the first conical plate to the second end of the first funnel;

wherein the second end of the first funnel is formed with an opening such that when the second end of the first funnel is attached to the third end of the coupling pipe fluid flowing through the first connecting funnel will flow into the coupling pipe;

wherein the second connecting funnel is a funnel shaped opening that creates a fluid bearing connection from the second conical plate to the fifth end of the second funnel;

wherein the fifth end of the second funnel is formed with an opening such that when the fifth end of the second funnel is attached to the fourth end of the coupling pipe fluid flowing through the second connecting funnel will flow into the second connecting funnel.

18. The device according to claim 17 wherein the coupling pipe further comprises a cylindrical pipe;

wherein the third end of the coupling pipe attaches to the second end of the first funnel;

wherein the fourth end of the coupling pipe attaches to the fifth end of the second funnel.

19. The device according to claim 18 wherein the device further comprises a first handle and a second handle;

wherein the first handle forms a first loop on the device;

wherein the second handle forms a second loop on the device;

wherein the first handle is further defined with a seventh end and an eighth end;

wherein the second handle further comprises a ninth end and a tenth end;

wherein the first handle is a u shaped structure;

wherein the second handle is a u shaped structure;

wherein the seventh end of the first handle attaches to the first exterior surface of the first hollow shell;

wherein the eighth end of the first handle attaches to the exterior face of the coupling pipe;

wherein the tenth end of the second handle attaches to the second exterior surface of the second hollow shell;

wherein the ninth end of the second handle attaches to the exterior face of the coupling pipe;

wherein the first handle is sized such that the first handle is contained with a hypothetical first right cylinder which is the smallest size that permits for the complete insertion of the first hollow shell such that the center axis of the hypothetical first right cylinder and the major axis of the quadric surface the forms the first hollow shell are aligned;

wherein the second handle is sized such that the second handle is contained with a hypothetical second right cylinder which is the smallest size that permits for the complete insertion of the second hollow shell such that the center axis of the hypothetical second right cylinder and the major axis of the quadric surface the forms the second hollow shell are aligned.

20. The device according to claim 19 wherein the first quadric surface be selected from the group consisting of a cone or an ellipsoid;

wherein the second quadric surface be selected from the group consisting of a cone or an ellipsoid;

wherein the first plug is formed from silicone;

wherein the second plug is formed from silicone.

* * * * *